US011213873B2

(12) United States Patent
Stankus et al.

(10) Patent No.: US 11,213,873 B2
(45) Date of Patent: Jan. 4, 2022

(54) MINE BOLT BENDING SYSTEM

(71) Applicant: FCI Holdings Delaware, Inc., Wilmington, DE (US)

(72) Inventors: John C. Stankus, Canonsburg, PA (US); Zachary Stevens, Pittsburgh, PA (US); Dakota Faulkner, Wexford, PA (US); Mark Crable, Adah, PA (US); Karl Anthony Calandra, Pittsburgh, PA (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 20 days.

(21) Appl. No.: 16/898,801

(22) Filed: Jun. 11, 2020

(65) Prior Publication Data

US 2020/0398326 A1 Dec. 24, 2020

Related U.S. Application Data

(60) Provisional application No. 62/864,644, filed on Jun. 21, 2019.

(51) Int. Cl.

| | |
|---|---|
| ***B21D 7/025*** | (2006.01) |
| ***B21D 7/06*** | (2006.01) |
| *E21D 21/00* | (2006.01) |

(52) U.S. Cl.

CPC ..... *B21D 7/066* (2013.01); *B21D 7/025* (2013.01); *E21D 21/0026* (2013.01)

(58) Field of Classification Search

CPC ..... B21D 7/02; B21D 7/022; B21D 7/024; B21D 7/066; E21D 21/0026

See application file for complete search history.

(56) References Cited

U.S. PATENT DOCUMENTS

| | | | | |
|---|---|---|---|---|
| 4,079,592 | A | 3/1978 | Eakin | |
| 4,085,492 | A | 4/1978 | Stange | |
| 4,085,495 | A | 4/1978 | Hebert | |
| 4,784,531 | A | 11/1988 | Calandra, Jr. | |
| 5,419,660 | A | 5/1995 | Marquis | |
| 5,879,231 | A | 3/1999 | Sisk | |
| 7,037,046 | B2 * | 5/2006 | Fergusson | E21D 21/0033 405/259.5 |
| 8,727,669 | B2 * | 5/2014 | Eddowes | E21D 20/003 405/259.1 |
| 9,267,376 | B2 * | 2/2016 | Arnot | B21F 11/00 |
| 10,480,320 | B2 | 11/2019 | Bhagwat et al. | |
| 2003/0180098 | A1 | 9/2003 | Malkoski | |
| 2006/0248937 | A1 * | 11/2006 | Lovsin | B21D 7/022 72/301 |

(Continued)

FOREIGN PATENT DOCUMENTS

| | | |
|---|---|---|
| EP | 1027529 B1 | 9/2003 |

*Primary Examiner* — Benjamin F Fiorello

(74) *Attorney, Agent, or Firm* — The Webb Law Firm

(57) ABSTRACT

A mine bolt bending system includes a frame comprising a plurality of bolt receiving portions each configured to receive and hold a mine roof bolt, a bolt contact member secured to the frame, with the bolt contact member rotatable relative to the frame between a first position and second position, and an actuator secured to the frame, with the actuator configured to move the bolt contact member between the first and second positions. The bolt contact member is configured to bend a mine bolt when rotating from the first position to the second position.

15 Claims, 8 Drawing Sheets

(56) References Cited

U.S. PATENT DOCUMENTS

| | | | | |
|---|---|---|---|---|
| 2010/0011832 | A1* | 1/2010 | Mizumura | B21D 9/04 72/369 |
| 2014/0144201 | A1* | 5/2014 | Elder | B21D 7/063 72/369 |
| 2017/0203351 | A1* | 7/2017 | Gonzalez | B21D 35/005 |
| 2018/0221930 | A1* | 8/2018 | Del Fabro | B21D 11/12 |

* cited by examiner

MINE BOLT BENDING SYSTEM

CROSS-REFERENCE TO RELATED APPLICATION

This application claims priority to U.S. Provisional Application Ser. No. 62/864,644, filed Jun. 21, 2019, which is hereby incorporated by reference in its entirety.

BACKGROUND OF THE INVENTION

Field of the Invention

This present application relates to a system for bending mine bolts.

Description of Related Art

Mine roof bolts are used to reinforce unsupported rock formations adjacent to a mine opening. In particular, the roof of a mine is conventionally supported by tensioning the roof with steel bolts inserted into bore holes drilled in the mine roof that reinforce the unsupported rock formation above the mine roof. The mine roof bolt may be anchored mechanically to the rock formation by engagement of an expansion assembly on the distal end of the mine roof bolt with the rock formation. Alternatively, the mine roof bolt may be adhesively bonded to the rock formation with a resin bonding material inserted into the bore hole. A combination of mechanical anchoring and resin bonding may also be employed by using both an expansion assembly and resin bonding material.

A mechanically anchored mine roof bolt typically includes an expansion assembly threaded onto a distal threaded end of the bolt shaft and a drive head for rotating the bolt. A mine roof plate is positioned between the drive head and the mine roof surface. The expansion assembly generally includes a multi-prong shell supported by a threaded ring and a plug threaded onto the end of the bolt. When the prongs of the shell engage with rock surrounding a bore hole, and the bolt is rotated about its longitudinal axis, the plug threads downwardly on the shaft to expand the shell into tight engagement with the rock thereby placing the bolt in tension between the expansion assembly and the mine roof surface.

When resin bonding material is utilized, the bonding material penetrates the surrounding rock formation to adhesively join the rock strata and to firmly hold the roof bolt within the bore hole. Resin is typically inserted into the mine roof bore hole in the form of a two component plastic cartridge having one component containing a curable resin composition and another component containing a curing agent (catalyst). The two component resin cartridge is inserted into the blind end of the bore hole and the mine roof bolt is inserted into the bore hole such that the end of the mine roof bolt ruptures the two component resin cartridge. Upon rotation of the mine roof bolt about its longitudinal axis, the compartments within the resin cartridge are shredded and the components are mixed. The resin mixture fills the annular area between the bore hole wall and the shaft of the mine roof bolt. The mixed resin cures and binds the mine roof bolt to the surrounding rock. The mine roof bolt is typically rotated via a drive head. With bolts that are point anchored and tensioned, a breakaway nut may be used to rotate the bolt and subsequently tension the bolt upon curing of the resin bonding material.

In certain mines, such as mines with a short mining height, bolts with a pre-formed notch are utilized. A notched mine bolt 1 is shown in FIG. 1, which includes a notch or recessed area that facilitates the bending of the mine bolt 1. If the mine roof height is 40 inches tall, for example, and the strata requires the use of mine bolt 72 inches tall, the notched mine bolts are commonly manually bent by a roof bolter operator to allow the installation of the longer bolts. The bolts are subsequently straightened by further manual bending as the bolts are inserted into a bore hole. The frequent manual bending of the notched mine bolt 1 is strenuous and increases the risk of injury.

SUMMARY OF THE INVENTION

In one aspect or embodiment, a mine bolt bending system includes a frame having a plurality of bolt receiving portions each configured to receive and hold a mine bolt, a bolt contact member secured to the frame, with the bolt contact member rotatable relative to the frame between a first position and second position and the bolt contact member configured to bend a mine bolt when rotating from the first position to the second position. The system further includes an actuator secured to the frame, with the actuator configured to move the bolt contact member between the first and second positions.

The frame may include an upper portion and a lower portion, with the upper portion rotatable relative to the lower portion between an open position and a closed position and the plurality of bolt receiving portions positioned on the lower portion of the frame. The actuator and the bolt contact member may be secured to the upper portion of the frame. The system may include a lock configured to lock the upper portion of the frame in the closed position. The frame may include a base having a plurality of legs. The actuator may be a double-acting hydraulic cylinder. The bolt contact member may be rotatable between the first and second positions about a first shaft, with the actuator rotatably secured to the first shaft.

The actuator may be a hydraulic cylinder having a piston rod, with the piston rod having a retracted position and an extended position, and where movement of the piston rod from the retracted position to the extended position rotates the first shaft and moves the bolt contact member from the first position to the second position. The bolt contact member may be rotatable independently from the first shaft about a second shaft, with the first shaft spaced from the second shaft. The bolt contact member may be secured to the first shaft via first and second contact arms extending from the first shaft, with the bolt contact member extending between the first and second contact arms and the first and second contact arms receiving the second shaft. The bolt contact member may be cylindrical.

The plurality of bolt receiving portions may each include spaced-apart projections defining a space configured to receive and hold a mine bolt between the spaced-apart projections. The bolt contact member may include first and second bolt contact members and the actuator may include first and second actuators.

The bolt contact member may be rotatable between the first and second positions via a pivot arm, with the pivot arm rotatable relative to the frame. The actuator may include a hydraulic cylinder having a piston rod with a retracted position and an extended position, with the piston rod secured to the bolt contact member via a pin connection, and where movement of the piston rod rotates the bolt contact member via the pivot arm and rotates the bolt contact member relative to the piston rod via the pin connection.

In some aspects or embodiments, the present disclosure may be characterized by one or more of the following clauses.

Clause 1: A mine bolt bending system comprising: a frame comprising a plurality of bolt receiving portions each configured to receive and hold a mine bolt; a bolt contact member secured to the frame, the bolt contact member rotatable relative to the frame between a first position and a second position, the bolt contact member configured to bend a mine bolt when rotating from the first position to the second position; and an actuator secured to the frame, the actuator configured to move the bolt contact member between the first and second positions.

Clause 2: The system of Clause 1, wherein the frame comprises an upper portion and a lower portion, the upper portion rotatable relative to the lower portion between an open position and a closed position, the plurality of bolt receiving portions positioned on the lower portion of the frame.

Clause 3: The system of Clause 2, wherein the actuator and the bolt contact member are secured to the upper portion of the frame.

Clause 4: The system of Clause 2 or Clause 3, further comprising a lock configured to lock the upper portion of the frame in the closed position.

Clause 5: The system of Clause 2 or Clause 3, wherein the frame comprises a base having a plurality of legs.

Clause 6: The system of any of Clauses 1-5, wherein the actuator comprises a double-acting hydraulic cylinder.

Clause 7: The system of any of Clauses 1-6, wherein the bolt contact member is rotatable between the first and second positions about a first shaft, the actuator rotatably secured to the first shaft.

Clause 8: The system of Clause 7, wherein the actuator comprises a hydraulic cylinder having a piston rod, the piston rod having a retracted position and an extended position, and wherein movement of the piston rod from the retracted position to the extended position rotates the first shaft and moves the bolt contact member from the first position to the second position.

Clause 9: The system of Clause 7 or Clause 8, wherein the bolt contact member is rotatable independently from the first shaft about a second shaft, the first shaft spaced from the second shaft.

Clause 10: The system of Clause 9, wherein the bolt contact member is secured to the first shaft via first and second contact arms extending from the first shaft, the bolt contact member extending between the first and second contact arms, the first and second contact arms receiving the second shaft.

Clause 11: The system of any of Clauses 1-10, wherein the bolt contact member is cylindrical.

Clause 12: The system of any of Clauses 1-11, wherein the plurality of bolt receiving portions each comprise spaced-apart projections defining a space configured to receive and hold a mine bolt between the spaced-apart projections.

Clause 13: The system of any of Clauses 1-12, wherein the bolt contact member comprises first and second bolt contact members and the actuator comprises first and second actuators.

Clause 14: The system of Clause 1, wherein the bolt contact member is rotatable between the first and second positions via a pivot arm, the pivot arm is rotatable relative to the frame.

Clause 15: The system of Clause 14, wherein the actuator comprises a hydraulic cylinder having a piston rod with a retracted position and an extended position, wherein the piston rod is secured to the bolt contact member via a pin connection, and wherein movement of the piston rod rotates the bolt contact member via the pivot arm and rotates the bolt contact member relative to the piston rod via the pin connection.

DETAILED DESCRIPTION OF THE INVENTION

Figure 1:
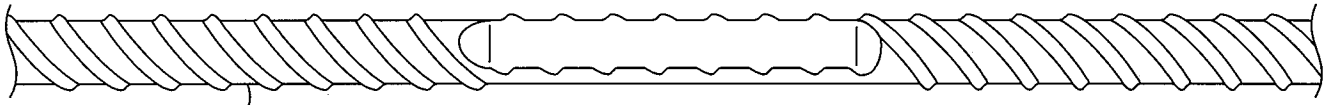
(PRIOR ART) FIG. 1
FIG. 1 is a partial top view of a conventional notched mine bolt.
Figure 2:
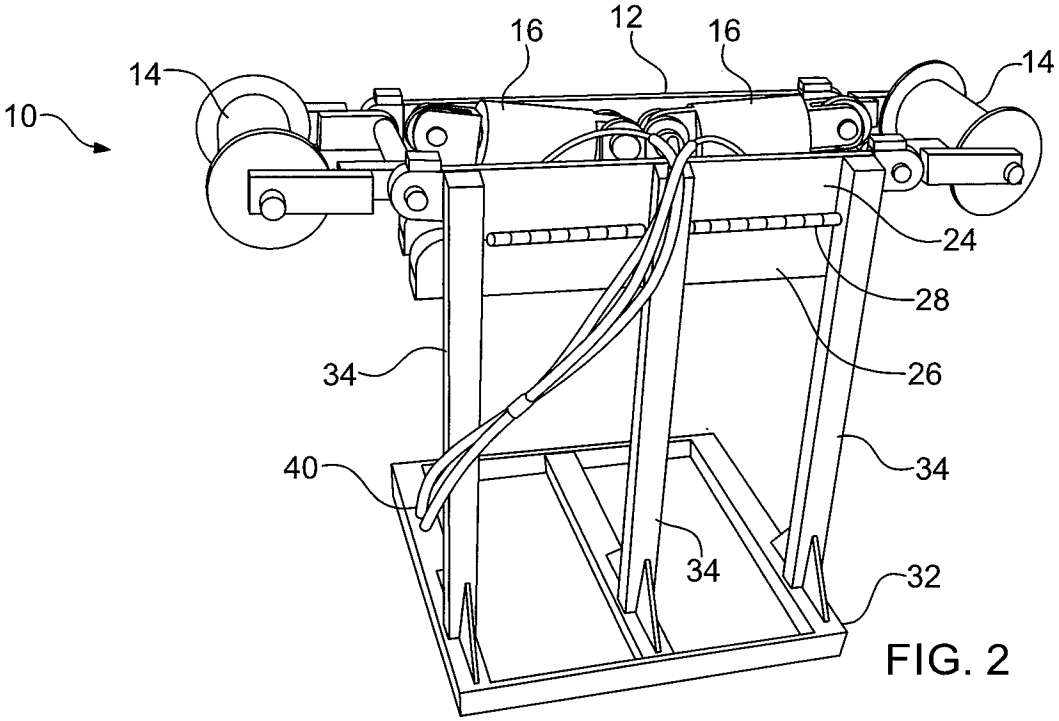
FIG. 2 is a rear perspective view of a mine bolt bending system according to one aspect or embodiment of the present application.

For purposes of the description hereinafter, the terms "upper", "lower", "right", "left", "vertical", "horizontal", "top", "bottom", and derivatives thereof, shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary aspects or embodiments of the invention. Hence, specific dimensions and other physical characteristics related to the aspects or embodiments disclosed herein are not to be considered as limiting. The terms "first", "second", and the like are not intended to refer to any particular order or chronology, but refer to different conditions, properties, or elements.

Figure 3:
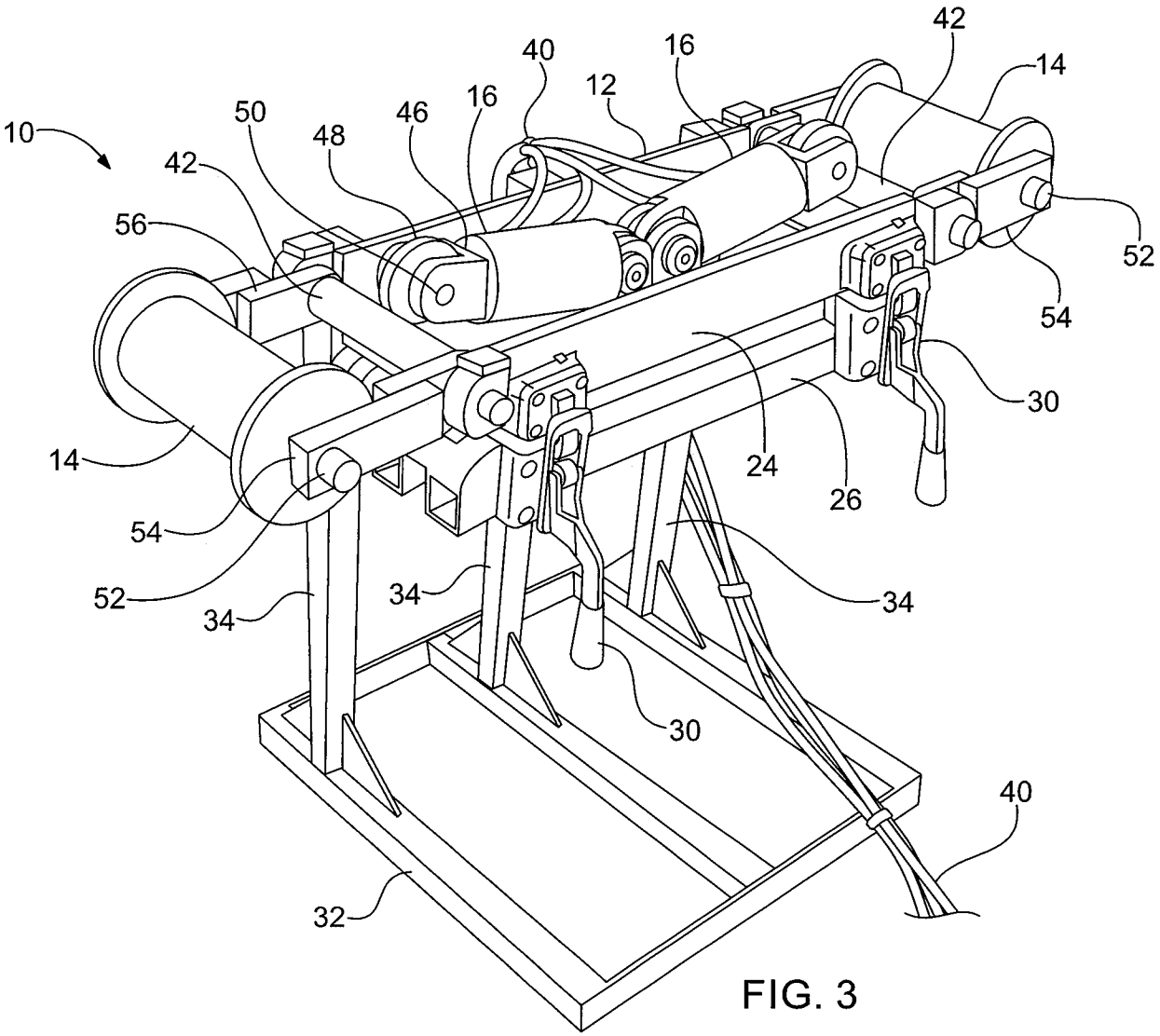
FIG. 3 is a front perspective view of the system of FIG. 2.
Figure 4:
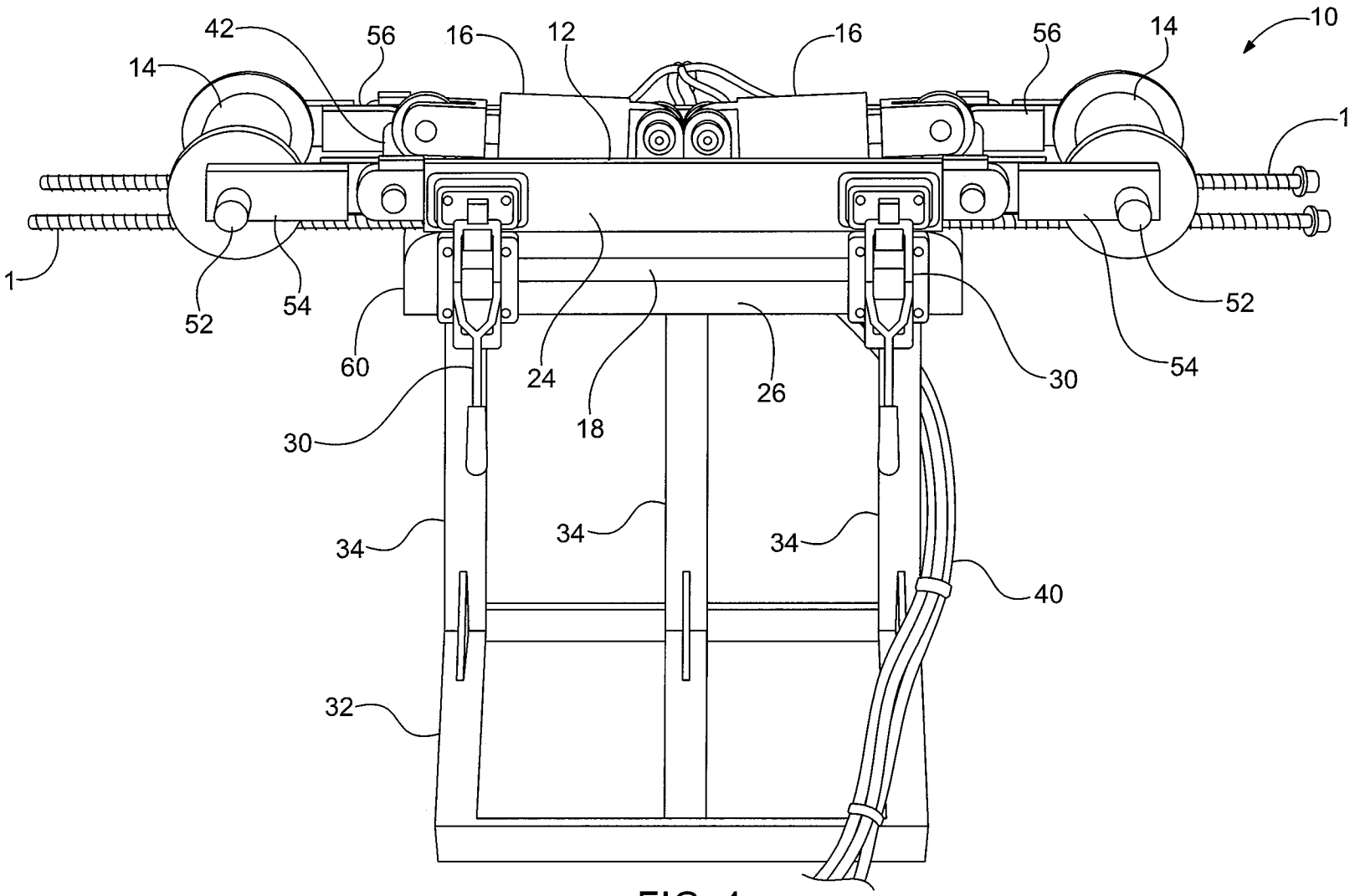
FIG. 4 is a front view of the system of FIG. 2, showing the system in a pre-use position.
Figure 5:
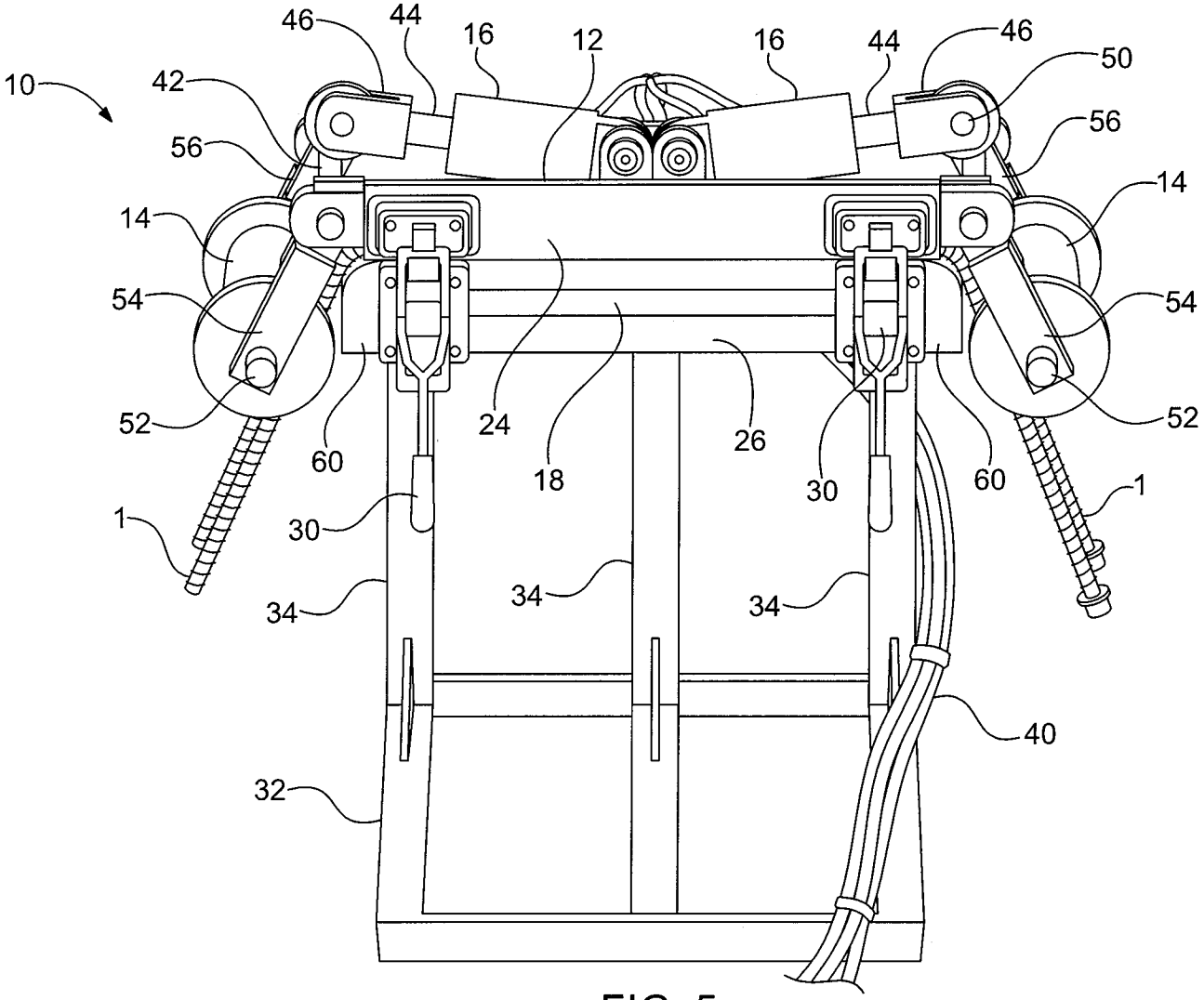
FIG. 5 is a front view of the system of FIG. 2, showing the system in a use position.
Figure 6:
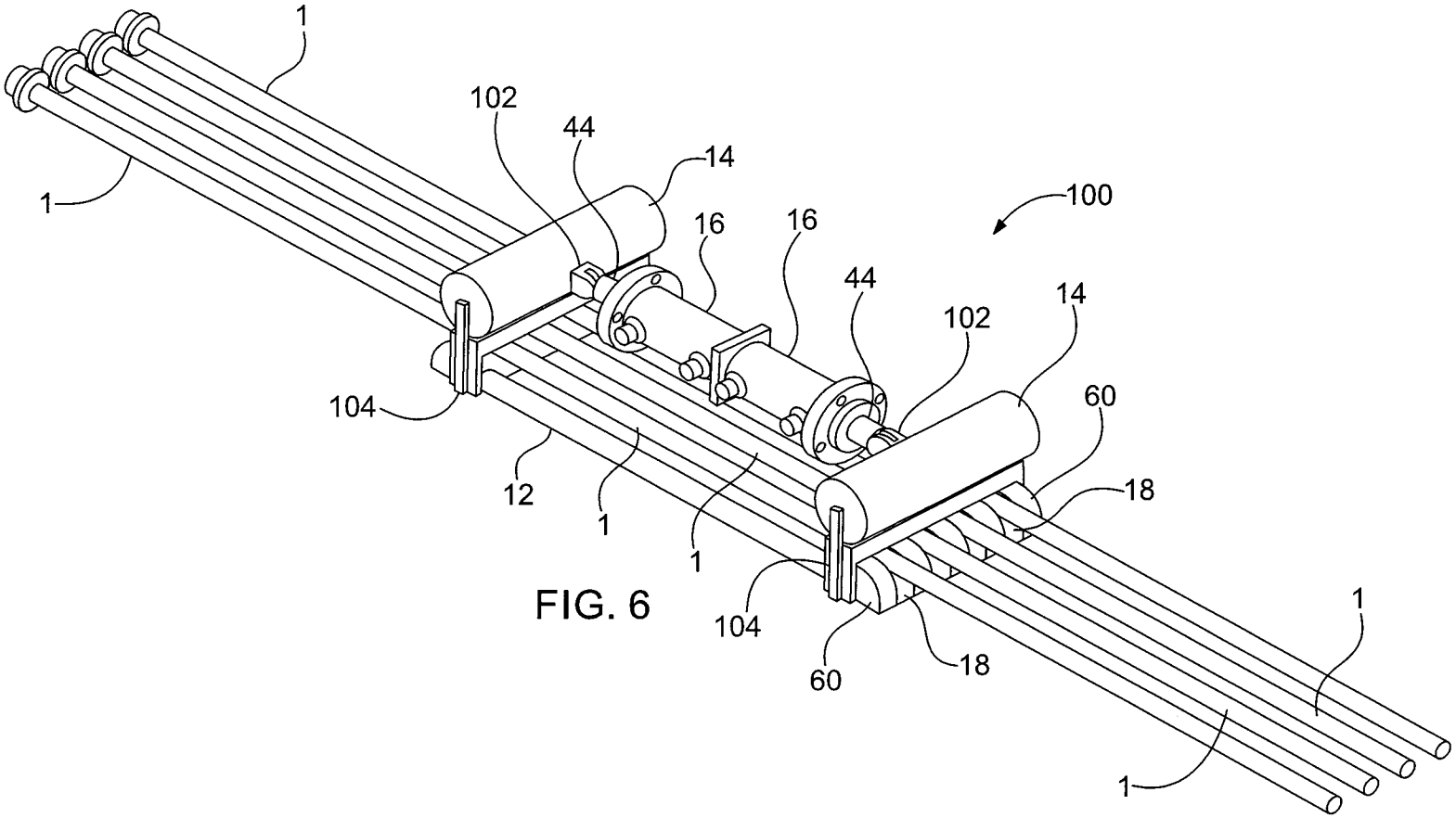
FIG. 6 is a perspective view of a mine bolt bending system according to a further aspect or embodiment of the present application.
Figure 7:
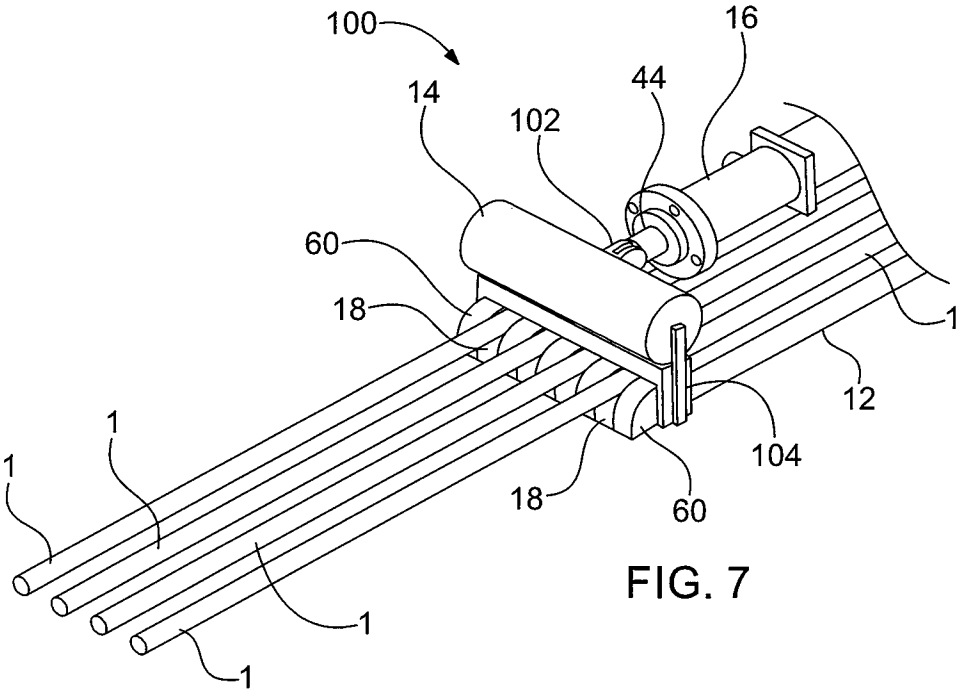
FIG. 7 is a partial perspective view of the system of FIG. 6, showing the system in a pre-use position.
Figure 8:
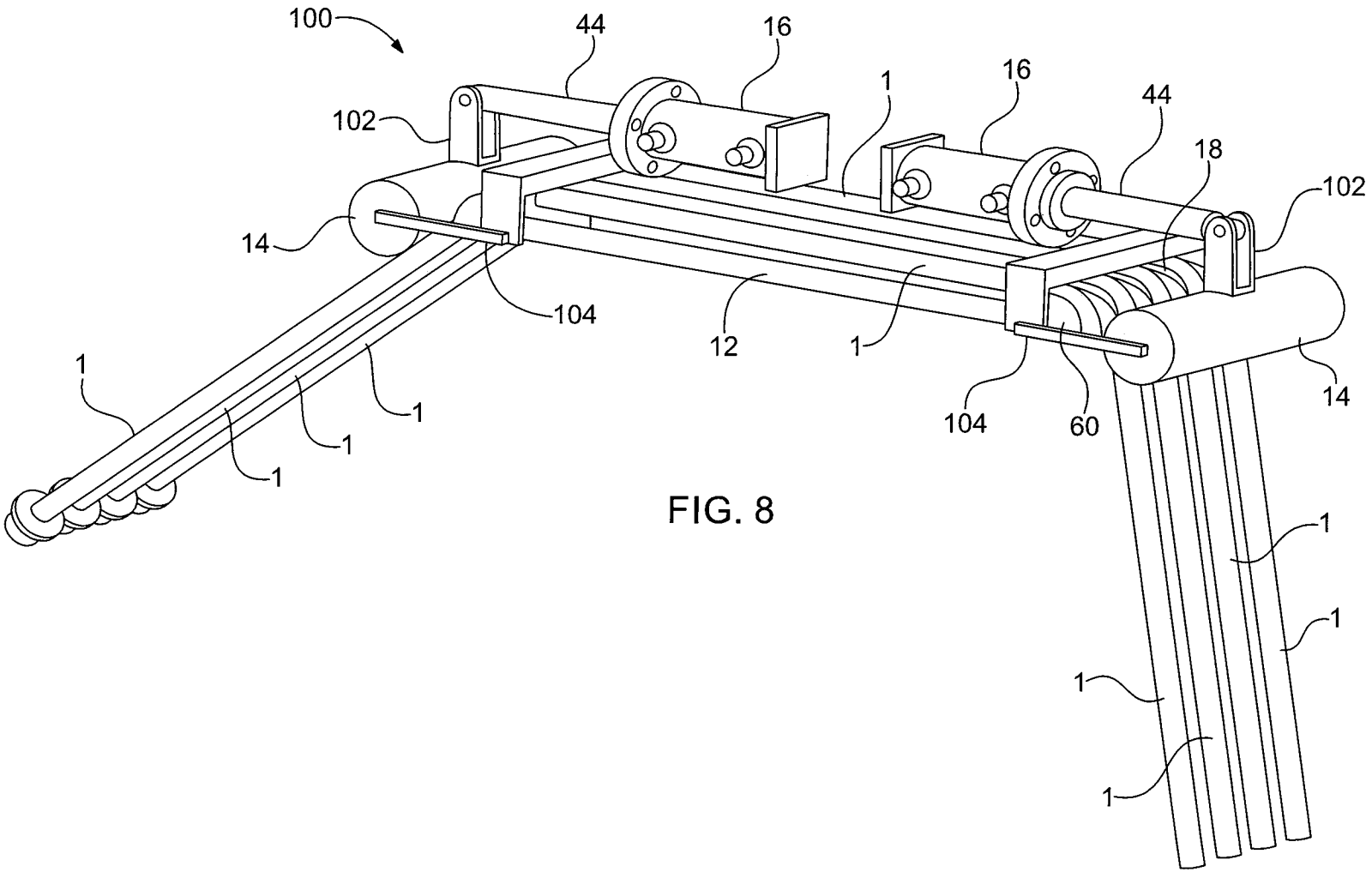
FIG. 8 is a perspective view of the system of FIG. 6, showing the system in a use position.
Figure 9:
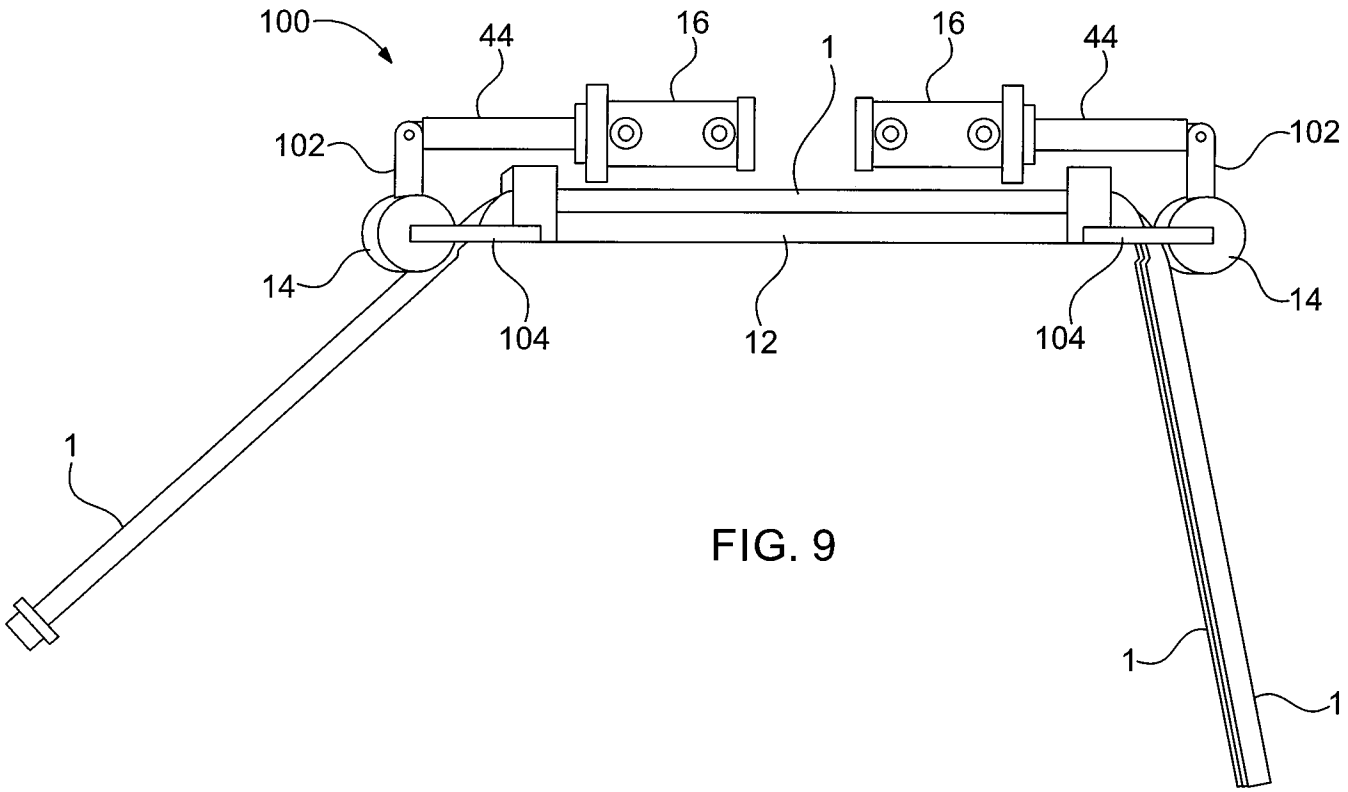
FIG. 9 is a side view of the system of FIG. 6, showing the system in a use position.

Referring to FIGS. 2-5, a mine bolt bending system 10 according to one aspect or embodiment of the present disclosure includes a frame 12, a bolt contact member 14 secured to the frame 12, and an actuator 16 secured to the frame 12. The frame 12 includes a plurality of bolt receiving portions 18 each configured to receive and hold the mine bolt 1. The bolt contact member 14 is rotatable relative to the frame 12 between a first position (FIG. 4) and a second position (FIG. 5). The actuator 16 is configured to move the bolt contact member 14 between the first and second positions. As discussed in more detail below, the bolt contact member 14 is configured to bend a mine bolt, such as the notched mine bolt 1 shown in FIG. 1, when rotating from the first position to the second position. More specifically, upon actuation of the actuator 16, the bolt contact member 14 is rotated from the first position towards the second position, with the bolt contact member 14 engaging the notched mine bolt 1 and bending the notched mine bolt 1 to a predetermined angle. The bolt 1 may be bent to any desirable angle, such as 1-90 degrees or, more particularly, between 30-80 degrees. The required angle of the bend of the notched mine bolt 1 typically depends on the conditions of the mine.

As shown in FIGS. 4 and 5, the system 10 is configured to bend four notched mine bolts 1 at a time, although the system 10 may be configured to bend one or more bolts 1 at a time. The system 10 also includes two bolt contact members 14 and two actuators 16 to either bend a single notched bolt or a double notched bolt. More specifically, the system 10 is configured to bend the notched mine bolt 1 at two separate, spaced-apart locations on each bolt 1.

Referring again to FIGS. 2-5, the frame 12 includes an upper portion 24 and a lower portion 26, with the upper portion 24 rotatable relative to the lower portion 26 between an open position and a closed position via a hinge 28, although other suitable connection arrangements may be utilized. The plurality of bolt receiving portions 18 are positioned on the lower portion 26 of the frame 12 and the actuator(s) 16 and the bolt contact member(s) 14 are secured to the upper portion 24 of the frame 12, although other suitable configurations may be utilized. Movement of the upper portion 24 of the frame 12 from the closed position to the open position allows the notched mine bolts 1 to be readily positioned on the respective bolt receiving portions 18 and to be readily removed from the bolt receiving portions 18 after the bolts 1 are bent. The upper portion 24 of the frame 12 is manually moved to the open position such that the upper portion 24 is further spaced from the lower portion 26 of the frame 12 relative to when the upper portion 24 of the frame 12 is in the closed position, which provides clearance to allow the bolts 1 to be removed vertically rather than sliding the bolts 1 into the frame 12 along their longitudinal axis. The system 10 further includes a lock 30 secured to the frame 12. The lock 30 is configured to lock the upper portion 24 of the frame 12 in the closed position, which ensures there is no relative movement between the upper and lower portions 24, 26 of the frame 12 during operation of the system 10. When placed on the bolt receiving portions 18, the notched mine bolts 1 may be clamped between the upper and lower portions 24, 26 of the frame 12 when the upper portion 24 is in the closed position, which fixes the position of the bolts 1 when the system 10 is in operation. The frame 12 includes a base 32 having a plurality of legs 34, which supports the upper and lower portions 24, 26 of frame 12 off of the ground. The frame 12 is configured to be portable to allow the system 10 to be readily transported and positioned underground to facilitate the bending of the notched bolts 1 during installation of the bolts 1.

The actuators 16 each comprise a double-acting hydraulic cylinder, although other suitable types of actuators 16 may be utilized. The actuators 16 are controlled via hydraulic lines 40, which are connected to a hydraulic system (not shown) typically having a hydraulic fluid reservoir, control system, and pump. The hydraulic lines 40 may be connected to external hydraulics from a shuttle car, although other suitable arrangements may be utilized.

Referring to FIGS. 3-5, each bolt contact member 14 is rotatable between the first position (FIG. 4) and the second position (FIG. 5) about a first shaft 42. Each actuator 16 is rotatably secured to the respective first shaft 42. A piston rod 44 of each actuator 16 has a retracted position (FIG. 4) and an extended position (FIG. 5). Movement of the piston rod 44 from the retracted position to the extended position, which may be accomplished through hydraulic control of the actuator 16, rotates the respective first shaft 42 and moves the respective bolt contact member 14 from the first position to the second position. A bracket 46 of each piston rod 44 is secured to the first shaft 42 via a lug 48 fixed to the first shaft 42, with a pin 50 extending through the bracket 46 and the lug 48 to allow relative rotation between the bracket 46 and the lug 48. The rotation between the piston rod 44 and the first shaft 42 allows the linear movement of the piston rod 44 to cause rotation of the first shaft 42 and the bolt contact member 14 relative to the piston rod 44. Each bolt contact member 14 is rotatable independently from the first shaft 42 about a second shaft 52, with the first shaft 42 spaced from the second shaft 52. Each bolt contact member 14 is secured to the first shaft 42 via first and second contact arms 54, 56 extending from the first shaft 42, with the bolt contact member 14 extending between the first and second contact arms 54, 56. The first and second arms 54, 56 receive the second shaft 52. The bolt contact member 14 is cylindrical, although other suitable shapes and configurations may be utilized.

Referring again to FIGS. 3-5, the plurality of bolt receiving portions 18 of the frame 12 each include spaced-apart projections 60 defining a space configured to receive and hold a mine bolt between the spaced-apart projections 60. The projections 60 are provided at each end of the frame 12 to secure the notched mine bolt 1 at two spaced-apart locations, although other suitable configurations may be utilized.

Referring to FIGS. 6-9, a mine bolt bending system 100 according to a further aspect is shown. The mine bolt bending system 100 is similar to the system 10 of FIGS. 2-5, except the piston rod 44 of the actuator 16 is directly secured to the bolt contact member 14 via a pin connection 102 rather than via the first shaft 42 as with the system 10 of FIGS. 2-5. Each bolt contact member 14 is rotatable between the first and second positions via pivot arms 104. The pivot arms 104 are secured to and rotatable relative to the frame 12. The bolt contact members 14 may also be independently rotatable relative to the respective pivot arms 104. Actuation of the actuators 16 causes each piston rod 44 to extend, which rotates the bolt contact member 14 via the pivot arm 104 and rotates the bolt contact member 14 relative to the piston rod 44 via the pin connection 102.

Referring to FIGS. 2-5, operating the system 10 to bend one or more notched mine bolts 1 includes moving the upper portion 24 of the frame 12 to the open position, placing one or more bolts 1 onto the respective bolt receiving portions 18, and moving the upper portion 24 of the frame 12 to the closed position. The actuator 16 is then actuated, such as through hydraulic control of the piston to move the piston rod 44 to the extended position, which rotates the first shaft 42 and the bolt contact member 14 until the bolt contact member 14 engages the notched mine bolts 1. Further movement of the piston rod 44 causes further rotation of the bolt contact member 14, which bends the notched mine bolt 1 until the predetermined angle is reached. As noted above, the notched mine bolt 1 may be bent in two spaced-apart locations simultaneously utilizing both of the actuators 16 and bolt contact members 14, although the system 10 may also be utilized to provide a single bend in the notched mine bolt 1. The system 100 of FIGS. 6-9 operates in the same manner as described above in connection with the system 10 of FIGS. 2-5.

The system illustrated in the attached drawings, and described in the specification, are exemplary embodiments or aspects of the invention. The present disclosure contemplates that, to the extent possible, one or more features of any embodiment or aspect can be combined with one or more features of any other embodiment or aspect.

The invention claimed is:

1. A mine bolt bending system comprising:

a frame comprising a plurality of bolt receiving portions each configured to receive and hold a mine bolt;

a bolt contact member secured to the frame, the bolt contact member rotatable relative to the frame between a first position and a second position, the bolt contact member configured to bend a mine bolt when rotating from the first position to the second position; and an actuator secured to the frame, the actuator configured to move the bolt contact member between the first and second positions.

2. The system of claim 1, wherein the frame comprises an upper portion and a lower portion, the upper portion rotatable relative to the lower portion between an open position and a closed position, the plurality of bolt receiving portions positioned on the lower portion of the frame.

3. The system of claim 2, wherein the actuator and the bolt contact member are secured to the upper portion of the frame.

4. The system of claim 2, further comprising a lock configured to lock the upper portion of the frame in the closed position.

5. The system of claim 2, wherein the frame comprises a base having a plurality of legs.

6. The system of claim 1, wherein the actuator comprises a double-acting hydraulic cylinder.

7. The system of claim 1, wherein the bolt contact member is rotatable between the first and second positions about a first shaft, the actuator rotatably secured to the first shaft.

8. The system of claim 7, wherein the actuator comprises a hydraulic cylinder having a piston rod, the piston rod having a retracted position and an extended position, and wherein movement of the piston rod from the retracted position to the extended position rotates the first shaft and moves the bolt contact member from the first position to the second position.

9. The system of claim 7, wherein the bolt contact member is rotatable independently from the first shaft about a second shaft, the first shaft spaced from the second shaft.

10. The system of claim 9, wherein the bolt contact member is secured to the first shaft via first and second contact arms extending from the first shaft, the bolt contact member extending between the first and second contact arms, the first and second contact arms receiving the second shaft.

11. The system of claim 10, wherein the bolt contact member is cylindrical.

12. The system of claim 1, wherein the plurality of bolt receiving portions each comprise spaced-apart projections defining a space configured to receive and hold a mine bolt between the spaced-apart projections.

13. The system of claim 1, wherein the bolt contact member comprises first and second bolt contact members and the actuator comprises first and second actuators.

14. The system of claim 1, wherein the bolt contact member is rotatable between the first and second positions via a pivot arm, the pivot arm is rotatable relative to the frame.

15. The system of claim 14, wherein the actuator comprises a hydraulic cylinder having a piston rod with a retracted position and an extended position, wherein the piston rod is secured to the bolt contact member via a pin connection, and wherein movement of the piston rod rotates the bolt contact member via the pivot arm and rotates the bolt contact member relative to the piston rod via the pin connection.

* * * * *